US009567849B2

(12) United States Patent
Graf et al.

(10) Patent No.: US 9,567,849 B2
(45) Date of Patent: Feb. 14, 2017

(54) TELEMETRY ANTENNA ARRANGEMENT

(71) Applicant: Scientific Drilling International, Inc., Houston, TX (US)

(72) Inventors: Stephan Graf, Paso Robles, CA (US); Matthew A. White, Templeton, CA (US); William Denzel, Templeton, CA (US); Nathan Paszek, Atascadero, CA (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 226 days.

(21) Appl. No.: 14/314,597

(22) Filed: Jun. 25, 2014

(65) Prior Publication Data

US 2015/0002307 A1 Jan. 1, 2015

Related U.S. Application Data

(60) Provisional application No. 61/840,208, filed on Jun. 27, 2013.

(51) Int. Cl.
*G01V 3/00* (2006.01)
*E21B 47/12* (2012.01)

(52) U.S. Cl.
CPC ..... *E21B 47/122* (2013.01)

(58) Field of Classification Search
CPC ..... E21B 47/122
See application file for complete search history.

(56) References Cited

U.S. PATENT DOCUMENTS

| | | | | |
|---|---|---|---|---|
| 6,392,561 | B1 | 5/2002 | Davies | |
| 7,255,183 | B2 * | 8/2007 | Cramer | E21B 17/028 166/242.6 |
| 8,154,420 | B2 * | 4/2012 | Petrovic | G01V 11/002 175/40 |
| 2008/0211687 | A1 | 9/2008 | Price et al. | |
| 2009/0072825 | A1 | 3/2009 | Prammer | |
| 2009/0194333 | A1 | 8/2009 | MacDonald | |
| 2013/0038332 | A1 | 2/2013 | Graf et al. | |

OTHER PUBLICATIONS

International Search Report and Written Opinion Issued in PCT Patent Application No. PCT/US2014/044082 dated Jun. 25, 2014 (19 pages).

* cited by examiner

*Primary Examiner* — Steven Lim
*Assistant Examiner* — Ryan Sherwin
(74) *Attorney, Agent, or Firm* — Adolph Locklar

(57) ABSTRACT

A sonde based antenna is used for communication within a wellbore. The sonde based antenna may include a toroidal antenna positioned about a conducting element. The sonde may be positionable within a gap sub. The sonde may be electrically connected to the first and second tubulars of the gap sub such that the tubulars are electrically coupled by the conducting element and are otherwise electrically insulated. The sonde may include a first and second structural member, the first and second structural members being electrically insulated except by the conducting element. The first and/or second structural element may extend through and/or around the toroidal antenna to, for example, add structural rigidity to the sonde.

38 Claims, 10 Drawing Sheets

TELEMETRY ANTENNA ARRANGEMENT

CROSS-REFERENCE TO RELATED APPLICATIONS

This application is a non-provisional application which claims priority to U.S. provisional application No. 61/840,208 filed Jun. 27, 2013, the entirety of which is hereby incorporated by reference.

TECHNICAL FIELD OF THE DISCLOSURE

This disclosure relates generally to wellbore communication. In particular, the disclosure relates to wireless communication of drilling information along a work string.

BACKGROUND OF THE DISCLOSURE

Directional drilling of boreholes is a well-known practice in the oil and gas industry and is used to place the borehole in a specific location in the earth. Present practice in directional drilling includes the use of a specially designed bottom hole assembly (BHA) in the drill string which includes, for example, a drill bit, stabilizers, bent subs, drill collars, rotary steerable and/or a turbine motor (mud motor) that is used to turn the drill bit. In addition to the BHA, a set of sensors and instrumentation, known as a measure while drilling system (MWD), may be used to provide information to the driller to guide and safely drill the borehole. Due to the mechanical complexity and the limited space in and around the BHA and mud motor, the MWD is typically placed above the motor assembly, which may place the MWD over 50 feet from the bit. A communication link to the surface is typically established by the MWD system using one or more means such as a wireline connection, mud pulse telemetry, or electromagnetic wireless transmission. Because lag between the bit location and the sensors monitoring the progress of the drilling, the driller at the surface may not be immediately aware that the bit is deviating from the desired direction or that an unsafe condition has occurred. For this reason, drilling equipment providers have worked to provide a means of locating some or all of the sensors and instrumentation in the limited physical space in or below the motor assembly and therefore closer to the drill bit while maintaining the surface telemetry system above the motor assembly.

SUMMARY

The present disclosure provides for a transceiver sonde for use in a short-hop wireless communication apparatus to transmit data from a first location in a wellbore on a first side of a mud motor or other mechanical obstruction to a second location on a second side of the mud motor or other mechanical obstruction. The transceiver sonde may be positionable within a gap sub. The transceiver sonde may include a toroidal antenna having a toroidal core and a coil, the coil wrapped around the toroidal core and positioned to induce or receive alternating electromagnetic transmission currents. The transceiver sonde may also include a conductive element passing through the toroidal antenna core having a first end and a second end, the conductive element forming a current path. The transceiver sonde may also include a first coupling junction electrically coupled to the first end of the conductive element and coupled to a first drill string tubular segment of the gap sub and a second coupling junction electrically coupled to the second end of the conductive element and coupled to a second drill string tubular segment of the gap sub. The second drill string tubular segment may be electrically insulated from the first drill string tubular segment such that the first and second drill string tubular segments are electrically connected by the conductive element.

The present disclosure also provides for a short hop wireless communication apparatus to transmit data from a lower location in a wellbore below a mud motor or other mechanical obstruction to an upper location above the mud motor or other mechanical obstruction. The short hop wireless communication apparatus may include an upper antenna assembly located at the upper location. The upper antenna assembly may include a gap sub, the gap sub having a first drill string tubular segment and a second drill string tubular segment, the drill string tubular segments being coupled together and generally collinear and electrically insulated from each other. The upper antenna assembly may also include a transceiver sonde positioned within the gap sub. The transceiver sonde may include a toroidal antenna including a toroidal core and a coil, the coil wrapped around the toroidal core and positioned to induce or receive alternating electromagnetic transmission currents. The transceiver sonde may also include a conductive element passing through the toroidal antenna core having a first end and a second end, the conductive element forming a current path. The transceiver sonde may also include a first coupling junction electrically coupled to the first end of the conductive element and coupled to the first drill string tubular segment of the gap sub. The transceiver sonde may also include a second coupling junction electrically coupled to the second end of the conductive element and coupled to the second drill string tubular segment of the gap sub. The upper antenna assembly may also include a transmission and receiving system in electrical contact with the coil positioned to transmit or receive alternating electromagnetic transmission currents. The short hop wireless communication apparatus may also include a lower antenna assembly located at the lower location. The lower antenna assembly may include at least one sensor. The lower antenna assembly may also include a transmission and receiving system in electrical contact with the at least one sensor positioned to transmit data received from the at least one sensor by data modulated alternating transmission currents through a lower antenna to be received by the upper antenna assembly, and to receive alternating transmission currents from the upper antenna assembly.

The present disclosure also provides for a method of transmitting and receiving data in a wellbore from a lower location in a wellbore below a mud motor or other mechanical obstruction to an upper location above the mud motor or other mechanical obstruction. The method may include providing a drill string bottom hole assembly. The method may also include providing a first gap sub, the gap sub including a first drill string tubular segment and a second drill string tubular segment, the drill string tubular segments being coupled together and generally collinear and electrically insulated from each other. The method may also include providing a transceiver sonde. The transceiver sonde may include a toroidal antenna including a toroidal core and a coil, the coil wrapped around the toroidal core and positioned to induce or receive alternating electromagnetic transmission currents. The transceiver sonde may also include a conductive element passing through the toroidal antenna core having a first end and a second end, the conductive element forming a current path. The transceiver sonde may also include a first coupling junction electrically coupled to the first end of the conductive element. The transceiver sonde may also include a second coupling junction electrically coupled to the second end of the conductive element. The method may also include positioning the transceiver sonde within the inner bore of the gap sub such that the first coupling junction is electrically coupled to the first drill string tubular segment, and the second coupling junction is electrically coupled to the second drill string tubular segment. The method may also include providing a transmission and receiving system in electrical contact with the coil positioned to transmit or receive alternating electromagnetic transmission currents. The method may also include providing a second antenna assembly, the second antenna assembly having at least one sensor and a transmission and receiving system in electrical contact with the at least one sensor positioned to transmit data received from the at least one sensor by data modulated alternating transmission currents through a lower antenna to be received by the upper antenna assembly, and to receive alternating transmission currents from the upper antenna assembly. The method may also include coupling the first gap sub and the second antenna assembly to the bottom hole assembly at a first and second location corresponding to one of the upper location and the lower location. The method may also include receiving information from the at least one sensor. The method may also include transmitting data modulated alternating transmission currents through the lower antenna. The method may also include receiving the data modulated alternating transmission currents by the transceiver sonde. The method may also include interpreting the information from the at least one sensor.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
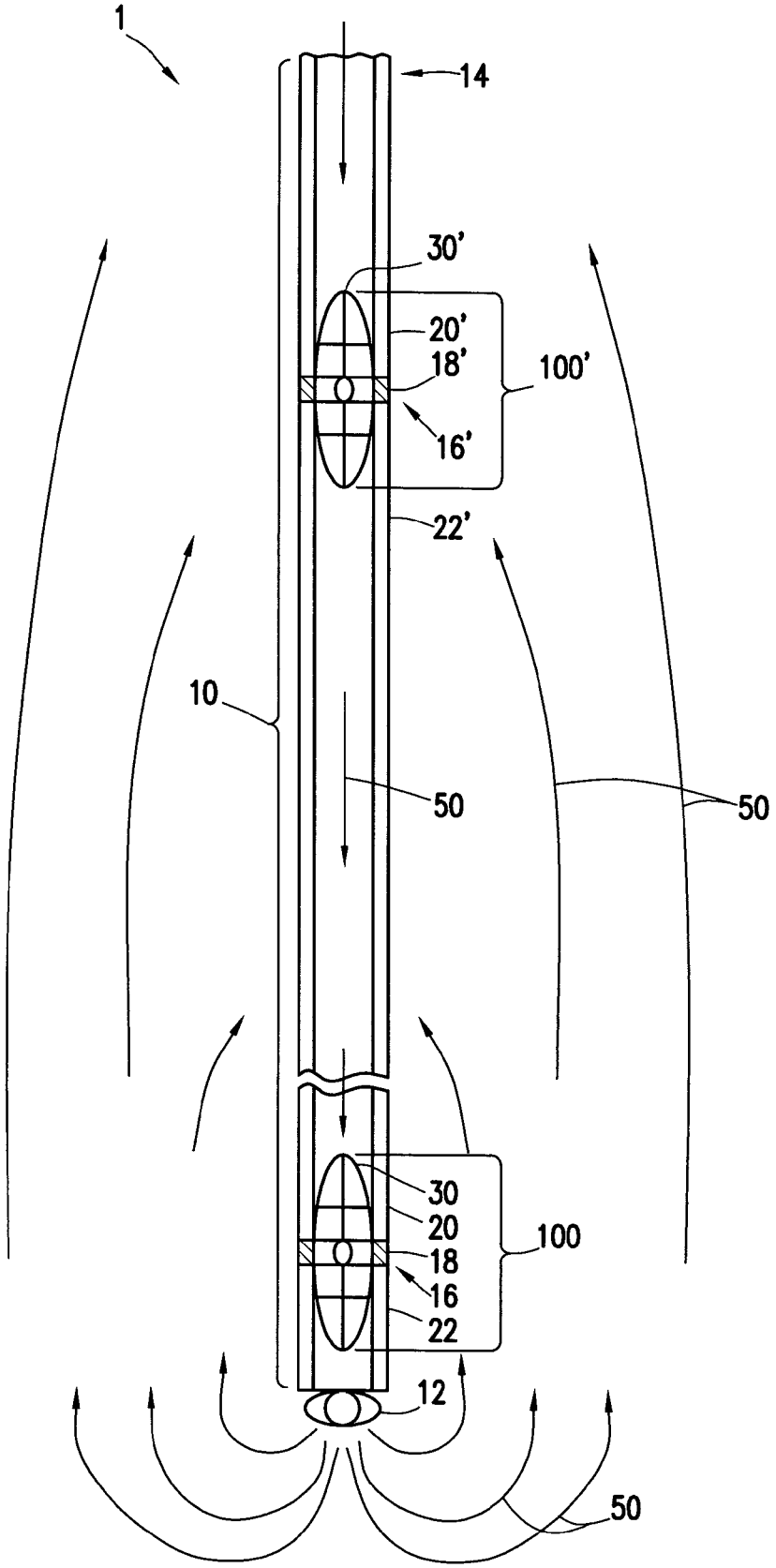
FIG. 1 is a partial cross-section of a downhole tool consistent with embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 illustrates a BHA 10 consistent with one embodiment of short hop wireless communication link 1. Short hop wireless communication link 1 provides for the establishment of a compact wireless uni- or bi-directional communication link between two transceivers located on BHA 10 of an oil or gas drilling assembly where a wired connection cannot be practically made. The BHA 10 includes a drill bit 12, connected to the lower end of drill string 14. Drill string 14 may be rotatably driven by a drill platform at the surface (not shown) or drill bit 12 may be driven by a mud motor included with BHA 10. BHA 10 may include mechanical obstructions which may not permit simple wireline communication through their interiors. For example, certain apparatuses, such as a mud motors, are mechanically complex and may not include paths through which wires may pass through the length of BHA 10.

BHA 10 includes a first and a second communications apparatus located on BHA 10 on either side of such a mechanical obstruction. In some embodiments of this disclosure, the first communications apparatus, as depicted in FIG. 1, is near-bit communications apparatus 100. One having ordinary skill in the art with the benefit of this disclosure will understand that the first communications apparatus need not be located at or near the drill bit, and that the mechanical obstruction may be a component other than a mud motor without deviating from the scope of this disclosure. The first communications apparatus is described herein as a near-bit communications apparatus 100 only for the sake of clarity and does not limit the scope of this disclosure. Near-bit communications apparatus 100 includes a power source, drilling environment sensors, a control system including memory circuit and communication management controller, and a transmitter and receiver all housed within BHA 10. Transmitter and receiver of near-bit communications apparatus 100 are depicted as including a gap sub 16 and transceiver sonde 30. Gap sub 16 includes an electrically insulating gap 18 positioned to separate two electrically conductive tubulars 20, 22 which make up a portion of the body of BHA 10. Gap 18 may include, as depicted, an insulating section to electrically isolate conductive tubulars 20, 22. Conductive tubulars 20, 22 are exposed to be in electrical contact with the surrounding drilling fluid (not shown) in the wellbore. Near-bit communications apparatus 100 communicates by driving an AC, data-modulated current on the drill string into the surrounding formation.

This current is received by an up-hole communications apparatus 100' and stored in memory circuitry in preparation for transmission by an associated surface link. Up-hole communications apparatus 100' is depicted as likewise including gap sub 16' and transceiver sonde 30'. Up-hole communications apparatus 100' may be in contact with other nearby sensor tools, and may contain or be in contact with management and control electronics sufficient to constitute an MWD system. Up-hole communications apparatus 100' contains the sensors, power supplies, control processor and electronics (not shown) required to both communicate upwardly with surface equipment and downwardly with the near-bit communications apparatus 100, with the end objective of collecting and communicating the most useful drilling condition data to the surface in a timely fashion. One having ordinary skill in the art with the benefit of this disclosure will understand that AC, data-modulated current may also be driven on the drill string and into the formation by up-hole communications apparatus 100' to be received by near-bit communications apparatus 100.

Such a short hop link typically supports data rates in the 10 to 50,000 baud range. Link carrier frequencies may be in the 100 to 100,000 Hz range. A plurality of codes and frequencies are typically used, depending on the link function and local conditions. Codes can be, but are not limited to, Frequency Shift Keying (FSK), Pulse Width Modulation (PWM), Pulse Position Modulation (PPM), Frequency Modulation (FM), and Phase Modulation (PM). Single and multiple simultaneous carrier frequencies may be used, both within and outside of the frequency range. Current injection into the formation may be utilized.

Figure 2:
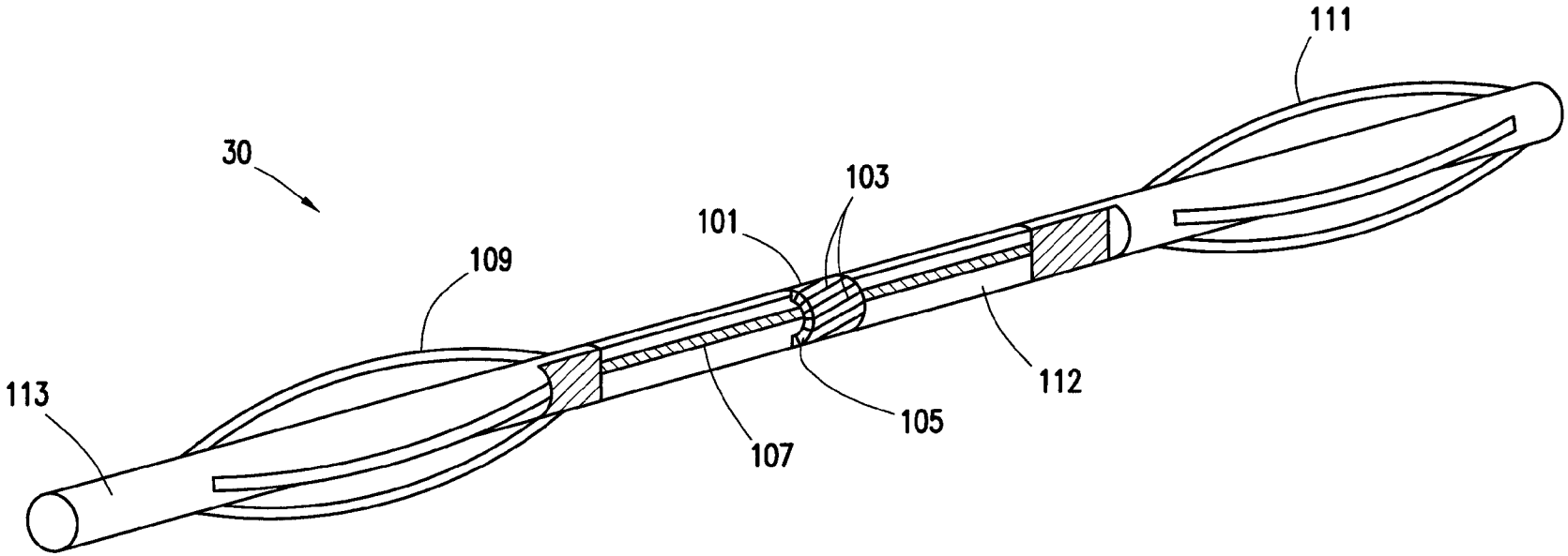
FIG. 2 is a cut-away view of a downhole telemetry sonde consistent with at least one embodiment of the present disclosure.

Referring to FIG. 2, transceiver sonde 30 includes at least one toroidal antenna 101. Toroidal antenna 101 includes coil 103 and a toroidal core 105, typically a ferromagnetic material as understood in the art. Toroidal core 105 may be a full, gapped, or split core as understood in the art. Coil 103 is formed from a continuous strand of wire, typically enameled magnet wire, wound helically around toroidal core 105. In other embodiments, coil 103 is formed from a non-insulated wire. In a transmitting mode, coil 103 is electrically energized by a control system (not shown) electrically connected to each lead of coil 103 to induce an electromagnetic field in toroidal antenna 101. Alternatively, in a receiving mode, coil 103 is electrically energized by an electric current passing through the middle of toroidal antenna 101, thereby allowing the control system to detect currents (shown in FIG. 1 as current lines 50) passing through toroidal antenna 101. In at least one embodiment, transceiver sonde 30 may include multiple toroidal antennae 101, e.g. with a separate toroidal antenna 101 for each of a transmitting mode and a receiving mode. In at least one embodiment, transceiver sonde 30 may include multiple toroidal antennae 101, e.g. with a separate toroidal antenna 101 for different transmission frequencies. In at least one embodiment, transceiver sonde 30 may include multiple toroidal antennae 101 configured to operate in a multiple-input and multiple-output (MIMO) configuration as understood in the art.

Figure 3:
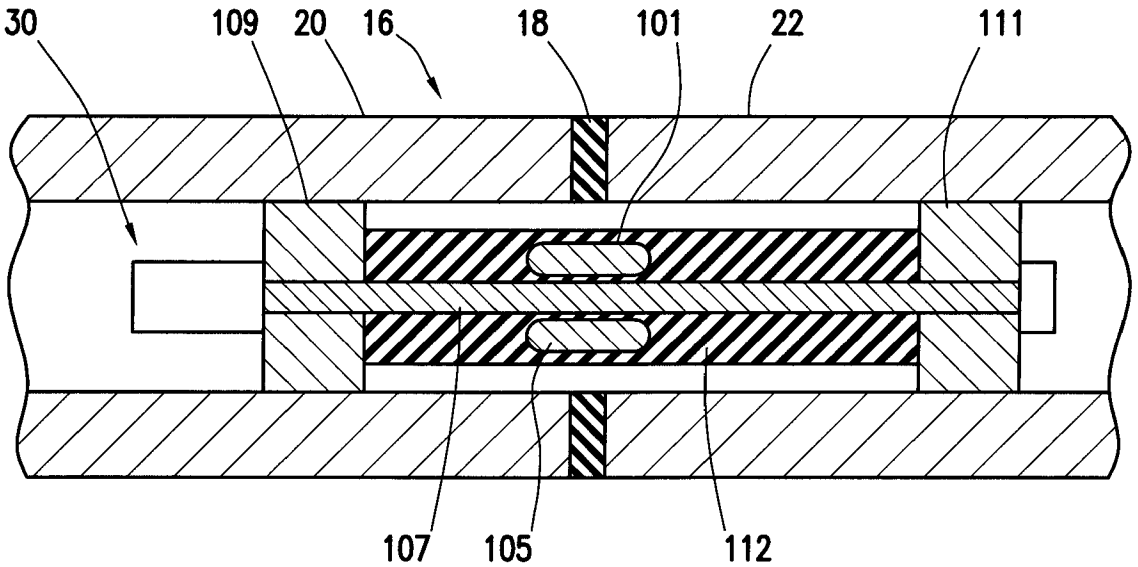
FIG. 3 is a schematic view of a downhole telemetry sonde installed in a downhole tool sub consistent with at least one embodiment of the present disclosure.
Figure 3A:
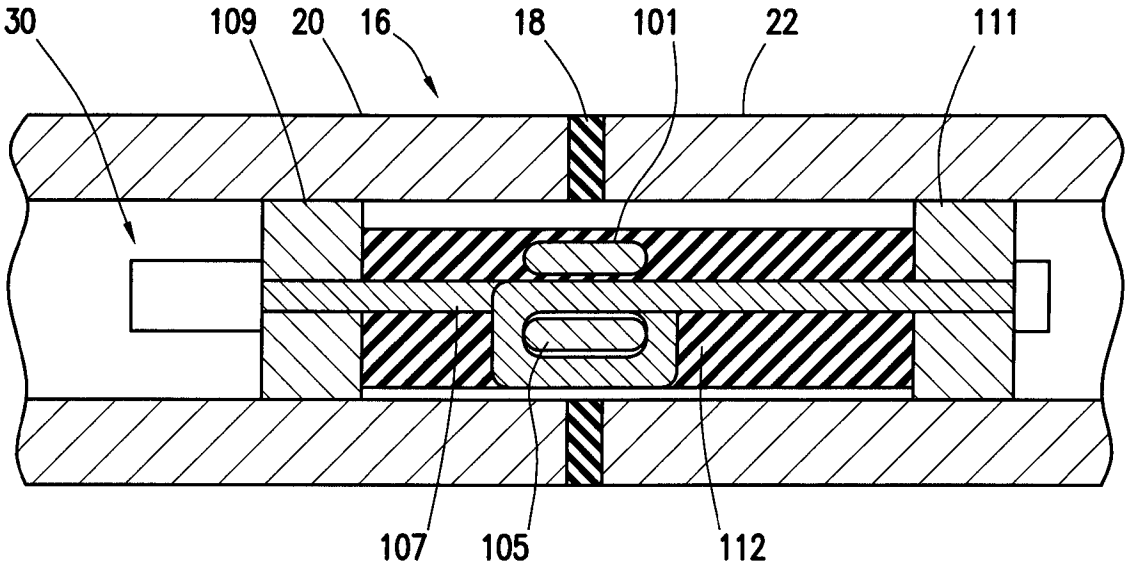
FIG. 3*a* is a schematic view of a downhole telemetry sonde installed in a downhole tool sub consistent with at least one embodiment of the present disclosure.

Conductive element 107 is positioned to pass through the interior of toroidal antenna 101. Conductive element 107 is electrically conductive, providing a conduction path for electric currents to travel through toroidal antenna 101 into coupling junctions 109, 111, also constructed from electrically conductive materials. Conductive element 107 may pass directly through toroidal antenna 101 as depicted in FIGS. 2, 3, or may pass multiple times through toroidal antenna 101 as depicted in FIG. 3*a*. In some embodiments, both a single pass and multiple pass conductive element 107 may be present coupled in parallel between coupling junctions 109, 111. The two parallel conductive elements 107 may be configured with a switch to select between a single or multiple pass conductive path. By selecting the number of windings of coil 103 and the turns through toroidal antenna 101 of conductive element 107, the gain of toroidal antenna 101 may be adjusted. One having ordinary skill in the art with the benefit of this disclosure will understand that although the figures depict conductive element 107 as filling the entirety of the interior of toroidal antenna 101, conductive element may only take up a small portion of the interior of toroidal antenna 101, thereby allowing for other equipment including, for example, other wires, to pass through the interior of toroidal antenna 101.

The outer surface of transceiver sonde 30 may be covered by insulating material 112 which encloses toroidal antenna 101 and conductive element 107 to protect them and, for example, physically isolate them from drilling fluid within the gap sub.

Returning to FIG. 2, coupling junctions 109, 111 are positioned to electrically couple either end of conductive element 107 with the inner surface of each tubular in a gap sub, warranting a conduction path for the electric current through the toroidal antenna. Coupling junctions 109, 111 are depicted in FIG. 2 as bow-springs, but may comprise any other extension from sonde chassis 113 capable of providing continuous electrical contact between the surrounding tubulars and conductive element 107. Coupling junctions 109, 111 may be formed from, for example, set screws, flanges, bow springs, wires, or any other means capable of providing continuous electrical contact between conductive element 107 and the surrounding tubulars. In another embodiment, coupling junctions 109, 111 may originate at the surrounding tubulars and extend to make continuous electrical contact with the sonde. By using bow-springs for coupling junctions 109, 111, a single size of transceiver sonde 30 may be used with multiple diameters of surrounding tubulars. Coupling junctions 109, 111 may be formed separately from transceiver sonde 30, and selected from a plurality of different sized coupling junctions to use transceiver sonde 30 with different diameters of surrounding tubulars.

In some embodiments, coupling junctions 109, 111 may also space transceiver sonde 30 apart from the interior walls of the gap sub such that drilling fluid flowing within gap sub may flow around the transceiver sonde 30. In other embodiments, drilling fluid may also flow through transceiver sonde 30.

As depicted in FIG. 3, coupling junction 109 electrically connects conductive element 107 to conductive tubular 20 on one side of gap 18. Likewise, coupling junction 111 connects conductive element 107 to conductive tubular 22 on the other side of gap 18. As conductive tubulars 20, 22 extend in opposing directions from gap 18, each forms a leg of a dipole antenna as understood in the art. In the transmission mode, current induced in conductive element 107 is transferred to conductive tubulars 20, 22 which behaves as a dipole antenna as understood in the art capable of transmitting data-modulated AC signals into the surrounding formation. Alternatively, in the receiving mode, data-modulated AC signals are detected as current flowing through conductive element 107 caused by an induced voltage differential between conductive tubular 20 and conductive tubular 22, thereby allowing sensing equipment (not shown) to receive a transmitted signal by measuring induced voltage or current in coil 103. Although toroidal antenna 101 is depicted in FIG. 3 as aligned with gap 18, one having ordinary skill in the art with benefit of this disclosure will understand that toroidal antenna 101 need not be aligned with gap 18.

In at least one embodiment, conductive element 107 may be configured with an electric switch, allowing electrical contact between conductive tubulars 20, 22 to be broken. Thus, gap sub 16 may be used as a gap antenna across which a control system may apply a modulated voltage to drive a modulated electro-magnetic field through the underground formation. The same gap may be used to detect voltage differences between conductive tubulars 20 and 22. Such a configuration provides an alternative communication method for short hop communications or communication to and from the surface.

Figure 8:
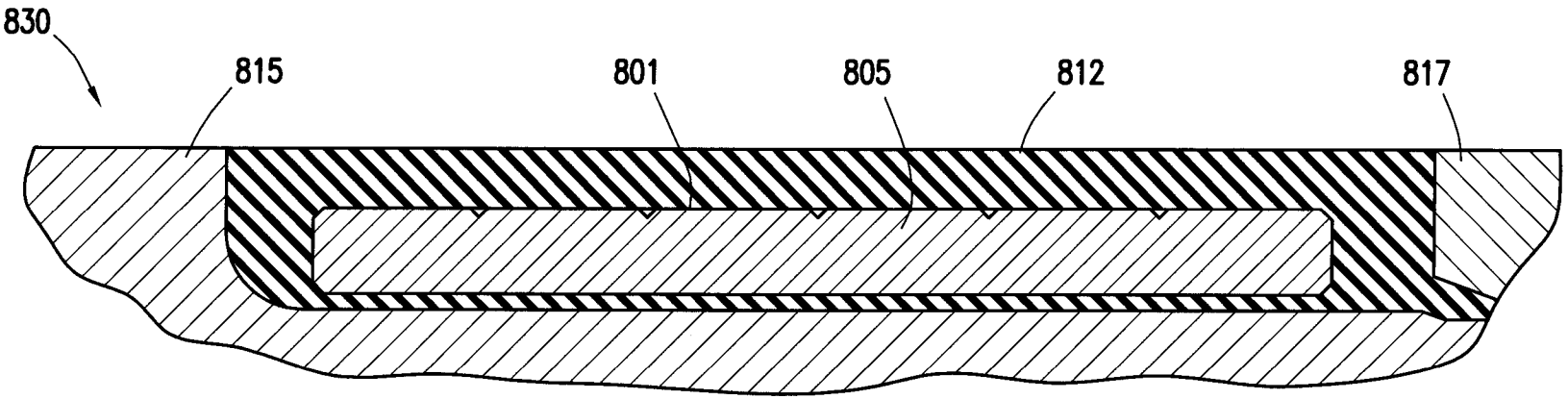
FIG. 8 is a partial cross-section of a downhole telemetry sonde consistent with at least one embodiment of the present disclosure.

In some embodiments, especially when transceiver sonde 30 is to be used with conductive drilling fluid including water-based fluid, insulating material 112 is positioned to overlap with the inner surface of gap 18 to, for example, prevent an additional shorting path from tubular 20 to tubular 22. As depicted in FIG. 8, transceiver sonde 830 includes toroidal antenna 801 having toroidal core 805. Toroidal antenna 801 is depicted as having insulating member 812 surrounding it and insulating it from structural element 815, structural element 817, and any surrounding drilling fluid. In some embodiments, structural element 815 may be formed as a part of tubular 20, and structural element 817 may be formed as a part of tubular 22. Structural elements 815, 817 are depicted as electrically insulated from each other by insulating member 812, here depicted as an insulating potting material. In some embodiments, insulating member 812 may be selected to increase the strength and rigidity of transceiver sonde 830, and may include, for example, one or more potting materials, sleeves, etc. In other embodiments in which structural elements 815, 817 form a sealed chamber around toroidal antenna 801, insulating member 812 may simply be an air gap surrounding toroidal antenna 801. In some embodiments, structural elements 815, 817 may provide a structural point to which coupling junctions (not shown) are attached, and may be either electrically insulated from the respective coupling junctions and conductive element (not shown), or may be electrically connected thereto. In some embodiments, structural elements 815, 817 are not electrically insulated. In some embodiments, a structural element, here depicted as structural element 815, may pass through the interior of toroidal core 805 to, for example, increase the strength and rigidity of transceiver sonde 830. In some embodiments, structural elements 815, 817 are formed as a single unit.

Figure 9A:
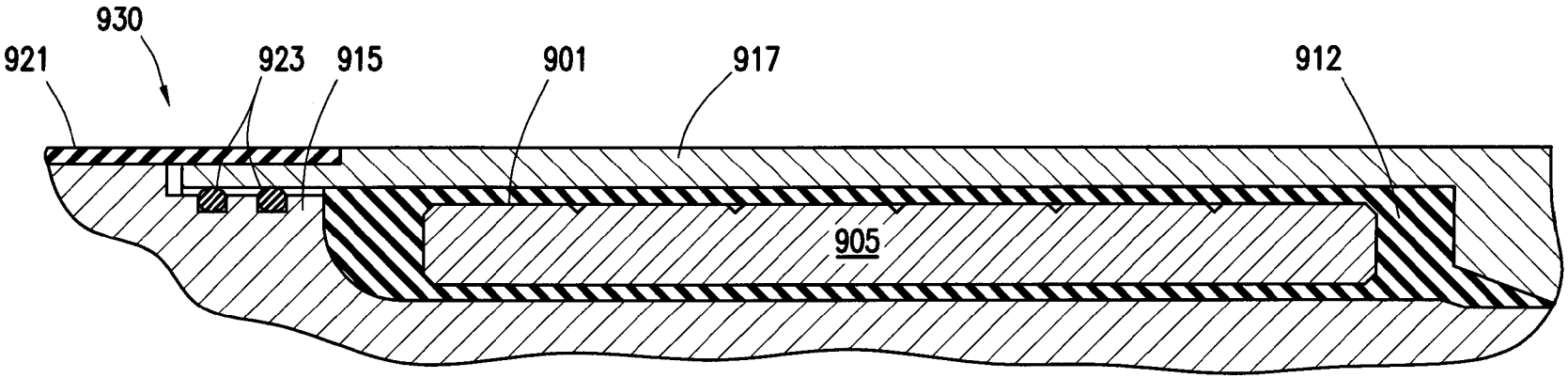
FIGS. 9*a*, 9*b*, 9*c* are partial cross-sections of a downhole telemetry sonde consistent with at least one embodiment of the present disclosure.
Figure 9B:
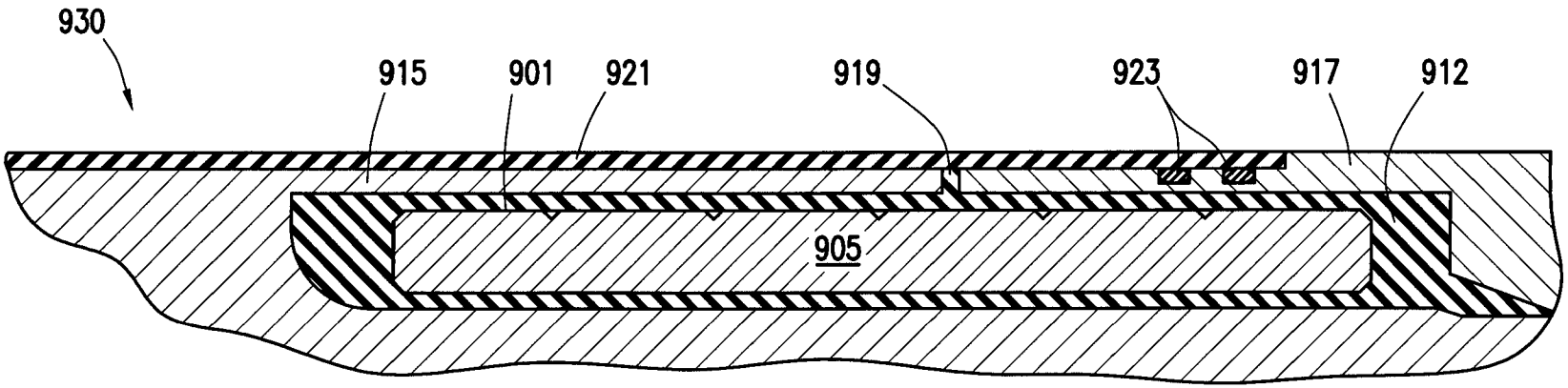

In some embodiments, transceiver sonde 30 may further include a tubular member surrounding insulating material 112. For example, as depicted in FIGS. 9*a*, 9*b*, transceiver sonde 930 includes toroidal antenna 901 having toroidal core 905. Toroidal antenna 901 is depicted as having insulating member 912 surrounding it and insulating it from structural elements 915, 917. Structural elements 915, 917 are depicted as electrically insulated from each other by insulating member 912, here depicted as an insulating potting material. In some embodiments, insulating member 912 may be selected to increase the strength and rigidity of transceiver sonde 930, and may include, for example, one or more potting materials, sleeves, etc. In other embodiments in which structural elements 915, 917 form a sealed chamber around toroidal antenna 901, insulating member 912 may simply be an air gap surrounding toroidal antenna 901. In some embodiments, structural elements 915, 917 may provide a structural point to which coupling junctions (not shown) are attached, and may be either electrically insulated from the respective coupling junctions and conductive element (not shown), or may be electrically connected thereto. In some embodiments, a structural element, here depicted as structural element 915, may pass through the interior of toroidal core 905 to, for example, increase the strength and rigidity of transceiver sonde 930. In some embodiments, structural elements 915 and 917 are formed as a single unit.

In an embodiment depicted in FIG. 9*a*, structural element 917 may be positioned around the outside of toroidal core 905 as well, which may likewise increase the strength and rigidity of transceiver sonde 930. Structural element 917 may overlap structural element 915, and may be separated therefrom by insulating member 912 or other insulating members (not shown). Additionally, at least one seal 923, here depicted as two O-rings, may be positioned between structural elements 915, 917 to assist in forming a fluid barrier. Additional embodiments may include an insulating sleeve 921 overlapping both structural elements 915, 917 to, for example, further strengthen the joint connecting the structural elements 915, 917. In additional embodiments, one or more structural elements 915, 917 may include additional grooves, recesses, slots, fingers, or other such geometry to optimize the strength of the joint.

In an embodiment depicted in FIG. 9*b*, both structural element 915 and 917 partially extend around the outside of toroidal core 905. Structural element 915 and 917 face each other at their furthest extent, and may be separated by insulating member 912 or other insulating members (not shown). This arrangement may likewise increase the strength and rigidity of transceiver sonde 930. Additional embodiments may include an insulating sleeve 921 overlapping both structural elements 915, 917 to, for example, further strengthen the joint connecting the structural elements 915, 917. Additionally, at least one seal 923, here depicted as two O-rings, may be positioned between insulating sleeve 921 and structural elements 915, 917 to assist in forming a fluid barrier. In additional embodiments, one or more structural elements 915, 917 may include additional grooves, recesses, slots, fingers, or other such geometry to optimize the strength of the joint.

Figure 9C:
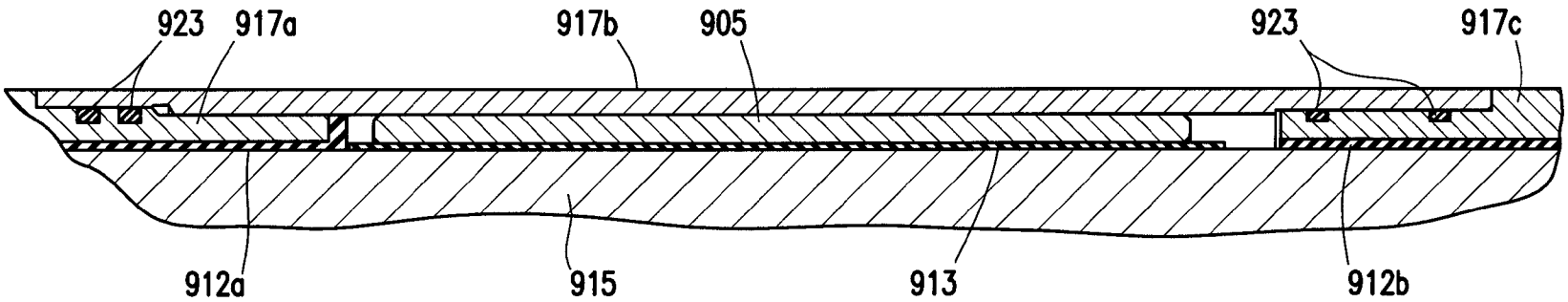

In some embodiments, one or more of structural elements 915, 917 may be made up of multiple individual tubular bodies. For example, as depicted in FIG. 9*c*, structural element 917 may be made up of, for example and without limitation, three tubular bodies 917*a-c*. Tubular bodies 917*a-c* may be positioned to extend around the outside of toroidal core 905. Structural element 915 may be separated from tubular bodies 917*a-c* by one or more insulating members, here depicted as insulating members 912*a*, 912*b*. In some embodiments, toroidal core 905 may be separated from structural element 915 using insulating member 913. In some embodiments, one or more seals 923 may be positioned to create a fluid barrier between tubular bodies 917*a-c*.

Figure 4:
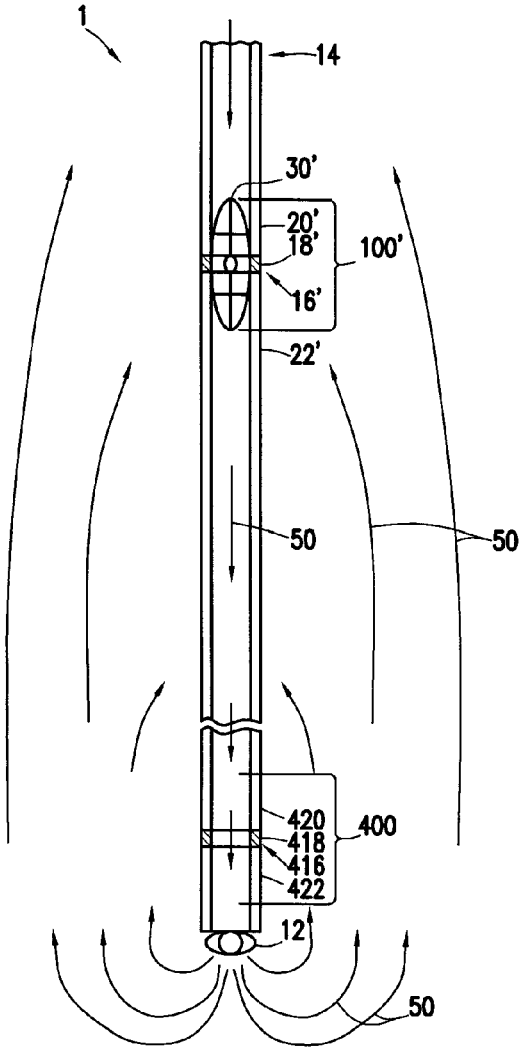
FIG. 4 is a partial cross-section of a downhole tool consistent with embodiments of the present disclosure.
Figure 5:
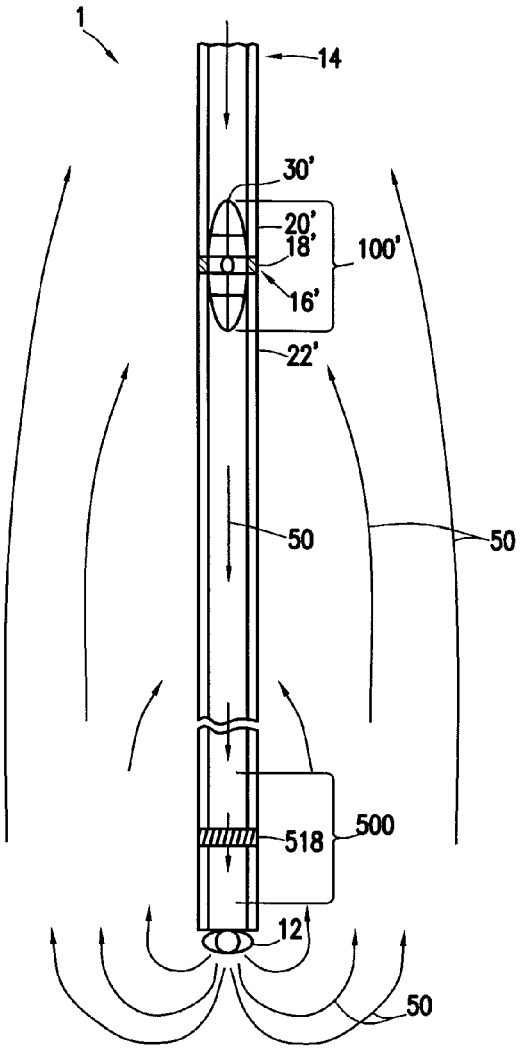
FIG. 5 is a partial elevational cross-section of a downhole tool consistent with embodiments of the present disclosure.

In some embodiments, a transceiver sonde 30 may be positioned to communicate with a different dipole antenna scheme. FIG. 4, for example, depicts near-bit communication apparatus 400 as utilizing a typical gap antenna. Gap sub 416 includes an electrically insulated gap 418 between conductive tubular members 420, 422. A control system, not shown, may apply a modulated voltage across gap 418 to drive a modulated electric current into the underground formation. FIG. 5 depicts near-bit communication apparatus 500 as utilizing a typical collar-based toroidal antenna 518 to drive a modulated electric current along the drill string 14 into the underground formation.

Figure 6:
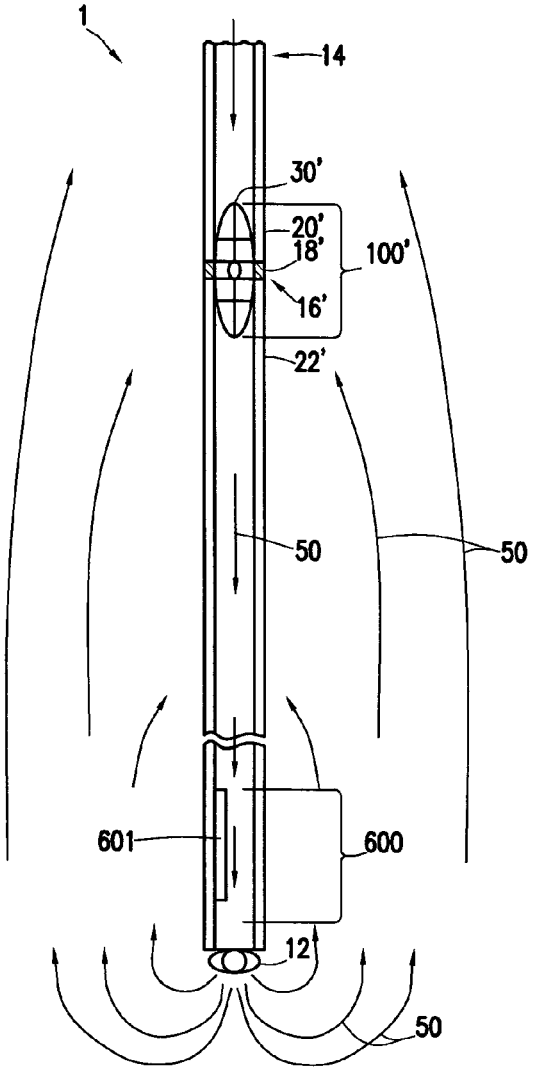
FIG. 6 is a partial cross-section of a downhole tool consistent with embodiments of the present disclosure.
Figure 7:
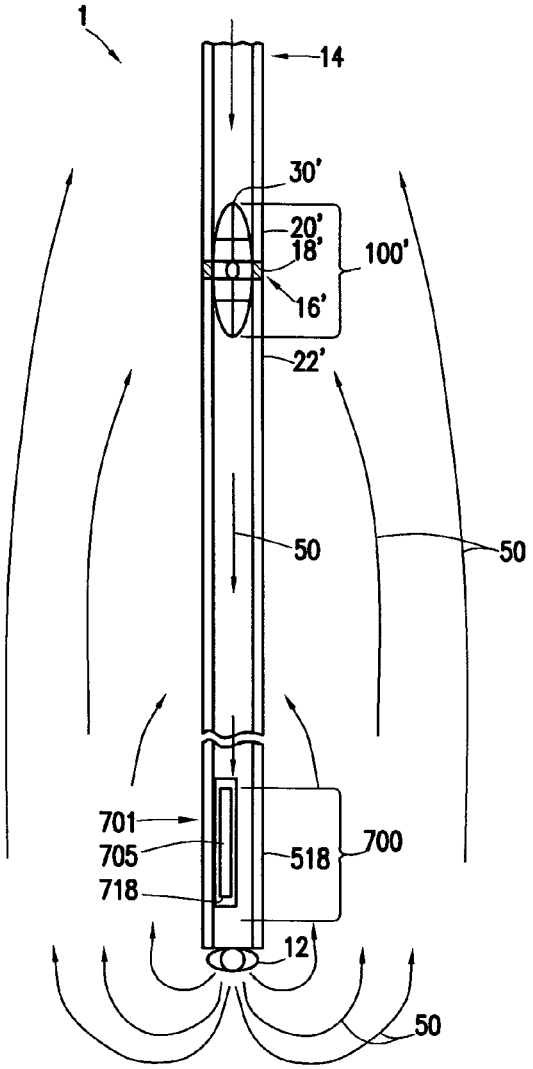
FIG. 7 is a partial cross-section of a downhole tool consistent with embodiments of the present disclosure.

FIG. 6 depicts near-bit communication apparatus 600 as using a cross coil antenna 601 to drive a modulated electric current into the underground formation. An exemplary cross coil antenna 601 is described in U.S. Patent Publication No. 2013/0038332, filed Aug. 10, 2012, the entirety of which is hereby incorporated by reference. FIG. 7 depicts near-bit communication apparatus 700 as using a point gap antenna 701 having an electrically conducting strip 705 that is at the surface, separated from the rest of the collar or drill string 720 by an insulated gap 718. Point gap antenna 701 is used to drive a modulated electric current into the underground formation. An exemplary point gap antenna 701 is described in U.S. Patent Publication No. 2008/0211687, filed Feb. 13, 2006, the entirety of which is hereby incorporated by reference. In FIGS. 4-7, up-hole communications apparatus 100' utilizes a gap sub 16' and transceiver sonde 30' as previously discussed.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

What is claimed is:

1. A transceiver sonde for use in a short-hop wireless communication apparatus to transmit data from a first location in a wellbore on a first side of a mud motor or other mechanical obstruction to a second location on a second side of the mud motor or other mechanical obstruction, the transceiver sonde positionable within a gap sub comprising:

a toroidal antenna having a toroidal core and a coil, the coil wrapped around the toroidal core and positioned to induce or receive alternating electromagnetic transmission currents;

a conductive element passing through the toroidal antenna core having a first end and a second end, the conductive element forming a current path;

a first coupling junction electrically coupled to the first end of the conductive element and coupled to a first drill string tubular segment of the gap sub; and a second coupling junction electrically coupled to the second end of the conductive element and coupled to a second drill string tubular segment of the gap sub, the second drill string tubular segment being electrically insulated from the first drill string tubular segment such that the first and second drill string tubular segments are electrically connected by the conductive element.

2. The transceiver sonde of claim 1, wherein the first coupling junction comprises at least one of a bow spring, set screw, flange, or wire.

3. The transceiver sonde of claim 1, wherein the first coupling junction is configured to be replaceable depending on the diameter of the drill string tubular segments of the gap sub.

4. The transceiver sonde of claim 1, wherein the first coupling junction comprises a first structural element, and the second coupling junction comprises a second structural element, the first and second structural elements are generally cylindrical members.

5. The transceiver sonde of claim 4, wherein the first structural element comprises a first body and a first extension which passes through the interior of the toroidal core from the first body and is separated and electrically insulated from the toroidal core and the second structural element by an insulating member.

6. The transceiver sonde of claim 5, wherein the second structural element comprises a second body and a second extension, and the first structural element comprises a third extension, the second and third extensions being generally tubular and in a facing configuration, the second and third extensions separated by a gap, the second and third extensions at least partially extending along the outside of the toroidal core and separated and electrically insulated from the toroidal core and the first structural element by an insulating member.

7. The transceiver sonde of claim 6, further comprising an insulating sleeve positioned around the separation between the second extension and the third extension.

8. The transceiver sonde of claim 5, wherein the second structural element comprises a second body and a second extension which extends about the outside of the toroidal core and is separated and electrically insulated from the toroidal core and the first structural element by an insulating member.

9. The transceiver sonde of claim 8, wherein the second extension comprises two or more tubular members.

10. The transceiver sonde of claim 8, wherein the second extension of the second structural element overlaps at least a part of the first body, and the portion of the second extension is separated from the first body by at least one seal.

11. The transceiver sonde of claim 10, further comprising an insulating sleeve positioned around the separation between the first body and the second extension.

12. The transceiver sonde of claim 1, wherein the conductive element further comprises a switch positioned to selectively open or close the current path through the conductive element.

13. The transceiver sonde of claim 12, further comprising a second conductive element, the second conductive element wrapped at least once around the toroidal antenna core and electrically coupling the first and second coupling junctions, the second conductive element comprising a second switch positioned to selectively open or close the current path through the second conductive element.

14. The transceiver sonde of claim 1, wherein the conductive element passes more than one time through the toroidal antenna.

15. The transceiver sonde of claim 14, wherein the conductive element further comprises a switch positioned to selectively open or close the current path through the conductive element.

16. The transceiver sonde of claim 1, wherein the toroidal antenna and conductive element are at least partially electrically insulated from drilling fluid travelling through the central bore of the gap sub.

17. The transceiver sonde of claim 1, further comprising a second toroidal antenna having a second toroidal core and a second coil, the second coil wrapped around the second toroidal core and positioned to induce or receive alternating transmission currents, wherein the first toroidal antenna is configured to be optimized for transmission of alternating transmission currents and the second toroidal antenna is configured to be optimized for the reception of alternating transmission currents.

18. The transceiver sonde of claim 17, wherein the conductive element does not pass through the second toroidal core, and the transceiver sonde further comprises a second conductive element which does not pass through the first toroidal core and passes at least once through the second toroidal core, the second conductive element electrically coupling the first and second coupling junctions.

19. The transceiver sonde of claim 1, further comprising a second toroidal antenna having a second toroidal core and a second coil, the second coil wrapped around the second toroidal core and positioned to induce or receive alternating transmission currents, wherein the first and second toroidal antennae are configured to be optimized for operation on different frequencies.

20. The transceiver sonde of claim 1, further comprising a second toroidal antenna having a second toroidal core and a second coil, the second coil wrapped around the second toroidal core and positioned to induce or receive alternating transmission currents, wherein the first and second toroidal antennae operate in a multiple-input and multiple-output (MIMO) configuration.

21. A short hop wireless communication apparatus to transmit data from a lower location in a wellbore below a mud motor or other mechanical obstruction to an upper location above the mud motor or other mechanical obstruction, said short hop wireless communication apparatus comprising:

an upper antenna assembly located at the upper location having:

a gap sub, the gap sub having a first drill string tubular segment and a second drill string tubular segment, the drill string tubular segments being coupled together and generally collinear and electrically insulated from each other;

a transceiver sonde positioned within the gap sub, the transceiver sonde having:

a toroidal antenna including a toroidal core and a coil, the coil wrapped around the toroidal core and positioned to induce or receive alternating electromagnetic transmission currents;

a conductive element passing through the toroidal antenna core having a first end and a second end, the conductive element forming a current path;

a first coupling junction electrically coupled to the first end of the conductive element and coupled to the first drill string tubular segment of the gap sub; and a second coupling junction electrically coupled to the second end of the conductive element and coupled to the second drill string tubular segment of the gap sub; and a transmission and receiving system in electrical contact with the coil positioned to transmit or receive alternating electromagnetic transmission currents; and a lower antenna assembly located at the lower location including:

at least one sensor; and a transmission and receiving system in electrical contact with the at least one sensor positioned to transmit data received from the at least one sensor by data modulated alternating transmission currents through a lower antenna to be received by the upper antenna assembly, and to receive alternating transmission currents from the upper antenna assembly.

22. The short hop wireless communication apparatus of claim 21, wherein the lower antenna comprises one of a transceiver sonde, a gap antenna, a point gap antenna, a cross coil antenna, or a collar based toroidal antenna.

23. The short hop wireless communication apparatus of claim 21, wherein the conductive element further comprises a switch positioned to selectively open the current path through the conductive element and electrically disconnect the first and second drill string tubular segments.

24. The short hop wireless communication apparatus of claim 23, further comprising a second conductive element, the second conductive element wrapped at least once around the toroidal antenna core and electrically coupling the first and second coupling junctions through a second current path, the second conductive element comprising a second switch positioned to selectively open or close the second current path.

25. The short hop wireless communication apparatus of claim 21, wherein the transmission and receiving system further comprises direct connections to the first and second drill string tubular segments of the gap sub to allow the gap sub to be used as a gap antenna while the transceiver sonde remains in place and the switch selectively opens the current path through the conductive element.

26. The short hop wireless communication apparatus of claim 21, wherein the transmission and receiving system further comprises a surface communication link allowing communication between the upper antenna assembly and the surface through mud pulse or electrical conduction-based communications.

27. The short hop wireless communication apparatus of claim 21, wherein the first coupling junction comprises a first structural element, and the second coupling junction comprises a second structural element, the first and second structural elements are generally cylindrical members.

28. The short hop wireless communication apparatus of claim 27, wherein the first structural element comprises a first body and a first extension which passes through the interior of the toroidal core from the first body and is separated and electrically insulated from the toroidal core and the second structural element by an insulating member.

29. The short hop wireless communication apparatus of claim 28, wherein the second structural element comprises a second body and a second extension, and the first structural element comprises a third extension, the second and third extensions being generally tubular and in a facing configuration, the second and third extensions separated by a gap, the second and third extensions traversing the outside of the toroidal core and separated and electrically insulated from the toroidal core and the first structural element by an insulating member.

30. The short hop wireless communication apparatus of claim 28, wherein the second structural element comprises a second body and a second extension which extends about the outside of the toroidal core and is separated and electrically insulated from the toroidal core and the first structural element by an insulating member.

31. The short hop wireless communication apparatus of claim 30, wherein the second extension of the second structural element overlaps at least a part of the first body, and the portion of the second extension is separated from the first body by at least one seal.

32. A method of transmitting and receiving data in a wellbore from a lower location in a wellbore below a mud motor or other mechanical obstruction to an upper location above the mud motor or other mechanical obstruction, the method comprising:

providing a drill string bottom hole assembly;

providing a first gap sub, the gap sub including a first drill string tubular segment and a second drill string tubular segment, the drill string tubular segments being coupled together and generally collinear and electrically insulated from each other;

providing a transceiver sonde, the transceiver sonde including:

a toroidal antenna including a toroidal core and a coil, the coil wrapped around the toroidal core and positioned to induce or receive alternating electromagnetic transmission currents;

a conductive element passing through the toroidal antenna core having a first end and a second end, the conductive element forming a current path;

a first coupling junction electrically coupled to the first end of the conductive element; and a second coupling junction electrically coupled to the second end of the conductive element;

positioning the transceiver sonde within the inner bore of the gap sub such that the first coupling junction is electrically coupled to the first drill string tubular segment, and the second coupling junction is electrically coupled to the second drill string tubular segment;

providing a transmission and receiving system in electrical contact with the coil positioned to transmit or receive alternating electromagnetic transmission currents;

providing a second antenna assembly, the second antenna assembly having at least one sensor and a transmission and receiving system in electrical contact with the at least one sensor positioned to transmit data received from the at least one sensor by data modulated alternating transmission currents through a lower antenna to be received by the upper antenna assembly, and to receive alternating transmission currents from the upper antenna assembly;

coupling the first gap sub and the second antenna assembly to the bottom hole assembly at a first and second location corresponding to one of the upper location and the lower location;

receiving information from the at least one sensor;

transmitting data modulated alternating transmission currents through the lower antenna;

receiving the data modulated alternating transmission currents by the transceiver sonde; and interpreting the information from the at least one sensor.

33. The method of transmitting and receiving data in a wellbore of claim 32, wherein the second antenna assembly comprises one of a second transceiver sonde, a gap antenna, a point gap antenna, a cross coil antenna, or a collar based toroidal antenna.

34. The method of transmitting and receiving data in a wellbore of claim 32, further comprising:

transmitting the information from the at least one sensor by the transmission and receiving system.

35. The method of transmitting and receiving data in a wellbore of claim 32, further comprising:

transmitting a control instruction from the surface to the transmission and receiving system;

transmitting data modulated alternating transmission currents representing the control instruction by the transceiver sonde; and receiving the data modulated alternating transmission currents representing the control instruction by the lower antenna.

36. The method of transmitting and receiving data in a wellbore of claim 32, wherein the conductive element further comprises a switch positioned to selectively open the current path through the conductive element and electrically disconnect the first and second drill string tubular segments.

37. The method of transmitting and receiving data in a wellbore of claim 36, wherein:

the transmission and receiving system is selectively coupled to the first and second drill string tubular segments of the gap sub to allow the gap sub to be used as a gap antenna while the transceiver sonde remains in place and the first and second coupling junctions are electrically disconnected; and the method further comprises:

operating the switch to selectively open the current path via the conductive element and electrically disconnect the first and second coupling junctions; and transmitting or receiving data modulated alternating transmission currents through the gap sub acting as a gap antenna.

38. The method of transmitting and receiving data in a wellbore of claim 36, wherein:

the transceiver sonde further comprises:

a second conductive element, the second conductive element wrapped at least once around the toroidal antenna core and electrically coupling the first and second coupling junctions through a second current path, the second conductive element comprising a second switch positioned to selectively open or close the second current path; and the method further comprises:

operating the first switch to selectively open the first current path via the first conductive element; and operating the second switch to selectively close the second current path, thereby connecting the first and second coupling junctions through the second conductive element.

* * * * *